US012571403B2

(12) United States Patent
Nichols et al.

(10) Patent No.: US 12,571,403 B2
(45) Date of Patent: Mar. 10, 2026

(54) NON-LINEAR IMPELLER BACKSWEEP

(71) Applicant: Pratt & Whitney Canada Corp., Québec (CA)

(72) Inventors: Jason Nichols, Mississauga (CA); Hien Duong, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/793,217

(22) Filed: Aug. 2, 2024

(65) Prior Publication Data

US 2026/0036134 A1 Feb. 5, 2026

(51) Int. Cl.

| | |
|---|---|
| ***F04D 29/28*** | (2006.01) |
| ***F04D 17/10*** | (2006.01) |
| ***F04D 29/44*** | (2006.01) |

(52) U.S. Cl.

CPC ..... *F04D 29/284* (2013.01); *F04D 17/10* (2013.01); *F04D 29/441* (2013.01)

(58) Field of Classification Search

CPC ..... F04D 17/10; F04D 29/284; F04D 29/30; F04D 29/441; F05D 2240/304; F05D 2240/38

See application file for complete search history.

(56) References Cited

U.S. PATENT DOCUMENTS

| | | | | |
|---|---|---|---|---|
| 4,543,041 | A | 9/1985 | French et al. | |
| 8,308,420 | B2 * | 11/2012 | Yagi | F04D 29/30 415/1 |
| 10,221,858 | B2 | 3/2019 | Berenyi et al. | |
| 10,801,514 | B2 * | 10/2020 | Cao | F04D 29/681 |
| 11,835,058 | B2 * | 12/2023 | Honda | F04D 29/30 |
| 2004/0052644 | A1 | 3/2004 | Decker et al. | |
| 2008/0229742 | A1 | 9/2008 | Renaud et al. | |
| 2016/0238019 | A1 * | 8/2016 | Kobayashi | F04D 29/286 |
| 2017/0305559 | A1 | 10/2017 | Bruno et al. | |
| 2020/0355198 | A1 * | 11/2020 | Honda | F04D 29/30 |
| 2023/0123100 | A1 * | 4/2023 | Honda | F04D 29/284 416/182 |
| 2024/0240647 | A1 | 7/2024 | Kanzaka et al. | |

FOREIGN PATENT DOCUMENTS

| | | | |
|---|---|---|---|
| CN | 220248445 | U | 12/2023 |
| WO | 2018188775 | A1 | 10/2018 |
| WO | 2023057774 | A1 | 4/2023 |

OTHER PUBLICATIONS

Search Report issued in European Patent Application No. 25193541.7; Date of Mailing Dec. 18, 2025 (11 pages).

* cited by examiner

*Primary Examiner* — Brian P Wolcott
(74) *Attorney, Agent, or Firm* — CANTOR COLBURN LLP

(57) ABSTRACT

A centrifugal compressor of an aircraft gas turbine engine includes an impeller having a hub, vanes and a shroud surrounding the hub and the vanes to form a flow path from an inducer portion at an upstream side of the impeller to an exducer portion at an impeller exit. Each vane includes, at the impeller exit, a trailing edge and the trailing edge of one or more vanes. The vanes include a hub-side trailing edge portion proximate to the hub and exhibiting backsweep of a first degree, and a shroud-side trailing edge portion proximate to the shroud and exhibiting backsweep of a second degree.

2 Claims, 6 Drawing Sheets

NON-LINEAR IMPELLER BACKSWEEP

BACKGROUND

Exemplary embodiments of the present disclosure relate generally to impellers and, in some embodiments, to an impeller of a centrifugal compressor of a gas turbine engine of an aircraft engine with non-linear impeller backsweep.

Centrifugal compressors are widely used in aerospace and industrial applications. An impeller of a centrifugal compressor can generate large increases in the total pressure of a working fluid by way of a radius change from the inlet of the impeller to the exit of the impeller. A diffuser is typically arranged downstream from the exit of the impeller and is used to convert kinetic energy from the impeller in the form of a velocity of the working fluid to potential energy in the form of static pressure of the working fluid. Diffuser performance is often strongly affected by impeller exit conditions.

Accordingly, a continuing need exists for improvements in centrifugal compressors that exhibit improved impeller exit conditions and thus improved diffuser performance.

BRIEF DESCRIPTION

According to a non-limiting embodiment, a centrifugal compressor of an aircraft gas turbine engine includes an impeller comprising a hub, vanes and a shroud surrounding the hub and the vanes to form a flow path from an inducer portion at an upstream side of the impeller to an exducer portion at an impeller exit. Each vane includes, at the impeller exit, a trailing edge and the trailing edge of one or more vanes. The vanes include a hub-side trailing edge portion proximate to the hub and exhibiting backsweep of a first degree, and a shroud-side trailing edge portion proximate to the shroud and exhibiting backsweep of a second degree.

In addition to one or more of the features described above, or as an alternative to any of the foregoing embodiments, the trailing edge of the one or more vanes further comprises a central trailing edge portion interposed between the hub-side trailing edge portion and the shroud-side trailing edge portion.

In addition to one or more of the features described above, or as an alternative to any of the foregoing embodiments, the hub-side trailing edge portion is adjacent to the hub and the shroud-side trailing edge portion is displaced from the shroud.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion by at least 10 degrees.

In addition to one or more of the features described above, or as an alternative to any of the foregoing embodiments, an angle of the backsweep of the second degree exhibited by the shroud-side trailing edge portion is about −15 degrees, and an angle of the backsweep of the first degree exhibited by the hub-side trailing edge portion is about −25 degrees.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion from about 90-95% chord to 100% chord.

In addition to one or more of the features described above, or as an alternative to any of the foregoing embodiments, a change of the backsweep of the second degree exhibited by the shroud-side trailing edge portion to the backsweep of the first degree exhibited by the hub-side trailing edge portion is at least one of distributed linearly over a length of the impeller and distributed non-linearly over a length of the impeller.

In addition to one or more of the features described above, or as an alternative to any of the foregoing embodiments, the trailing edge of each of the vanes comprises the hub-side trailing edge portion proximate to the hub and exhibiting the backsweep of the first degree, and the shroud-side trailing edge portion proximate to the shroud and exhibiting the backsweep of the second degree.

According to another non-limiting embodiment an impeller of a centrifugal compressor of an aircraft gas turbine engine is provided. The impeller comprises a hub, vanes, and a shroud surrounding the hub and the vanes to form a flow path from an inducer portion at an upstream side of the impeller to an exducer portion at an impeller exit. Each vane comprises, at the impeller exit, a trailing edge and the trailing edge of one or more vanes. The vanes comprise a hub-side trailing edge portion proximate to the hub and exhibiting backsweep of a first degree, and a shroud-side trailing edge portion proximate to the shroud and exhibiting backsweep of a second degree.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion.

According to yet another non-limiting embodiment, a centrifugal compressor of an aircraft gas turbine engine is provided. The centrifugal compressor comprises an impeller including a hub, main and splitter vanes and a shroud surrounding the hub and the main and splitter vanes to form a flow path from an inducer portion at an upstream side of the impeller to an exducer portion at an impeller exit. The main vanes extend from the inducer portion to the exducer portion. The splitter vanes are interleaved with the main vanes and extend to the exducer portion from an impeller mid-point. Each main vane comprises, at the impeller exit, a trailing edge and the trailing edge of one or more main vanes. Each of the vanes include a hub-side trailing edge portion proximate to the hub and exhibiting backsweep of a first degree, and a shroud-side trailing edge portion proximate to the shroud and exhibiting backsweep of a second degree.

In addition to one or more of the features described above, or as an alternative to any of the foregoing embodiments, the trailing edge of the one or more main vanes further comprises a central trailing edge portion interposed between the hub-side trailing edge portion and the shroud-side trailing edge portion.

In addition to one or more of the features described above, or as an alternative to any of the foregoing embodiments, the hub-side trailing edge portion is adjacent to the hub and the shroud-side trailing edge portion is displaced from the shroud.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion by at least 10 degrees.

In addition to one or more of the features described above, or as an alternative to any of the foregoing embodiments, an angle of the backsweep of the second degree exhibited by the shroud-side trailing edge portion is about −15 degrees, and an angle of the backsweep of the first degree exhibited by the hub-side trailing edge portion is about −25 degrees.

In addition to one or more of the features described above, or as an alternative to any of the foregoing embodiments, the backsweep of the second degree exhibited by the shroud-side trailing edge portion is less than the backsweep of the first degree exhibited by the hub-side trailing edge portion from about 90-95% chord to 100% chord.

In addition to one or more of the features described above, or as an alternative to any of the foregoing embodiments, a change of the backsweep of the second degree exhibited by the shroud-side trailing edge portion to the backsweep of the first degree exhibited by the hub-side trailing edge portion is at least one of distributed linearly over a length of the impeller and distributed non-linearly over a length of the impeller.

In addition to one or more of the features described above, or as an alternative to any of the foregoing embodiments, the trailing edge of each of the main vanes comprises the hub-side trailing edge portion proximate to the hub and exhibiting the backsweep of the first degree, and the shroud-side trailing edge portion proximate to the shroud and exhibiting the backsweep of the second degree.

These and other advantages and features will become more apparent from the following description taken in conjunction with the drawings.

BRIEF DESCRIPTION OF THE DRAWINGS

The following descriptions should not be considered limiting in any way. With reference to the accompanying drawings, like elements are numbered alike.

These and other advantages and features will become more apparent from the following description taken in conjunction with the drawings.

DETAILED DESCRIPTION

A detailed description of one or more embodiments of the disclosed apparatus and method are presented herein by way of exemplification and not limitation with reference to the Figures.

As noted above, centrifugal compressors are widely used in aerospace and industrial applications. An impeller of a centrifugal compressor can generate large increases in the total pressure of a working fluid by way of a radius change from the inlet of the impeller to the exit of the impeller. A diffuser is typically arranged downstream from the exit of the impeller and is used to convert kinetic energy from the impeller in the form of a velocity of the working fluid to potential energy in the form of static pressure of the working fluid. Diffuser performance is often strongly affected by impeller exit conditions. For example, maximum diffusion in the diffuser will occur with smooth inlet profiles. Achieving such smooth inlet profiles can be difficult however for several reasons. These reasons include, but are not limited to, impeller tip clearance between the impeller tip and the shroud, strong curvature in the impeller near the shroud and shock and/or boundary layer interactions.

Accordingly, a continuing need exists for improvements in centrifugal compressors that exhibit improved impeller exit conditions and thus improved diffuser performance.

As will be described below, an impeller of a centrifugal compressor is provided with an adjusted impeller trailing edge radius to cater for known deficits in total pressure at the impeller exit. The adjustment to the impeller trailing edge radius includes a modified shroud side of the impeller blade angle near the trailing edge. This increases the work done on the shroud side flow relative to the hub and generates higher pressure. Resulting pressure profiles will be more uniform and boost diffuser performance. An amount of backsweep change will be dependent on an amount of pressure to be recovered. For example, less backsweep on the shroud will result if the impeller has a large tip clearance, a small aspect ratio (i.e., a ratio of length to radius) or a relatively high specific speed (i.e., a high inlet relative Mach number). A difference in hub and shroud backsweep can be at least about 10 degrees with variation being linear or non-linear.

Figure 1:
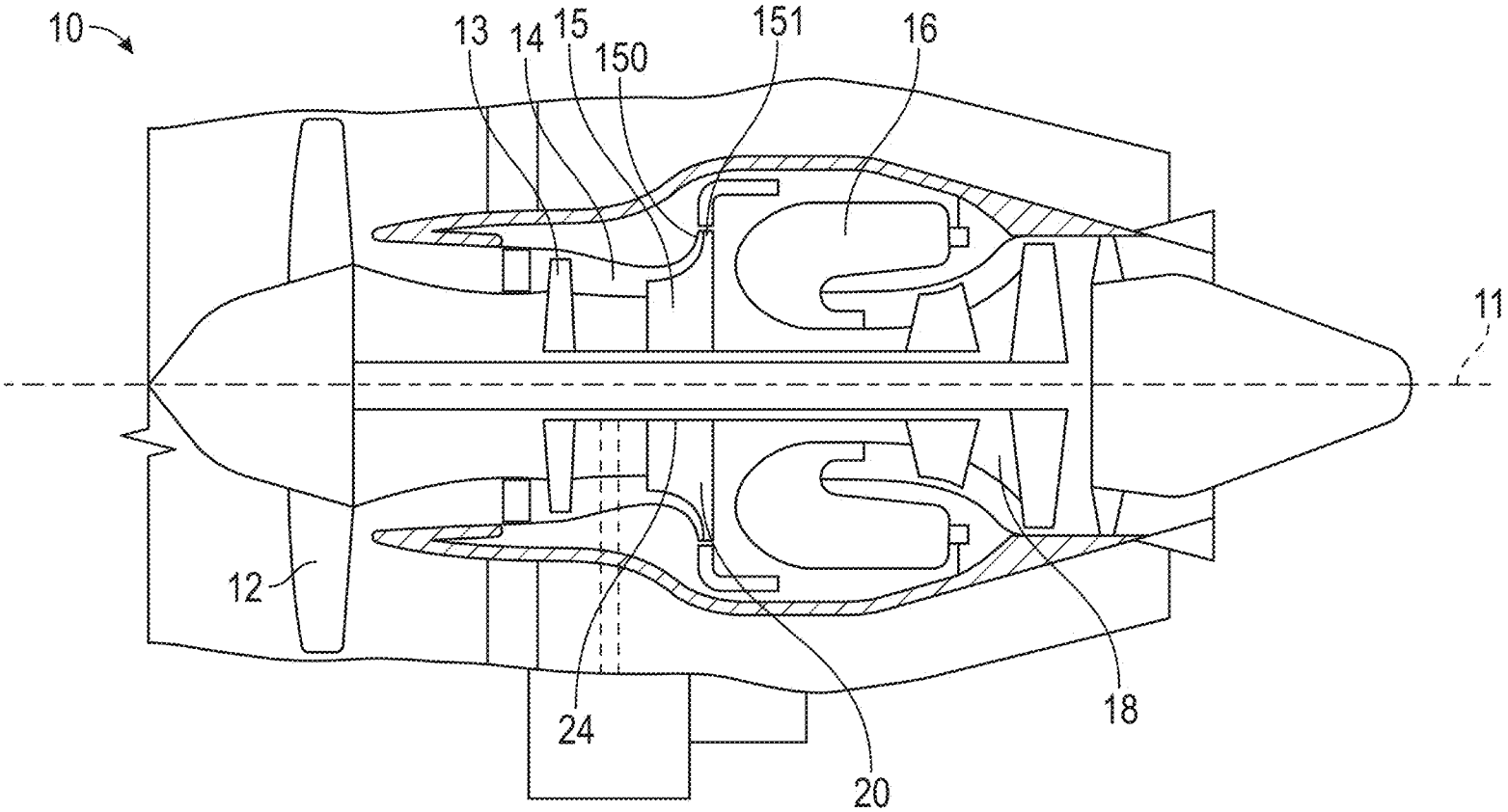
FIG. 1 (Prior Art)
FIG. 1 is a schematic cross-sectional view of a prior art gas turbine engine in accordance with embodiments.
Figure 2:
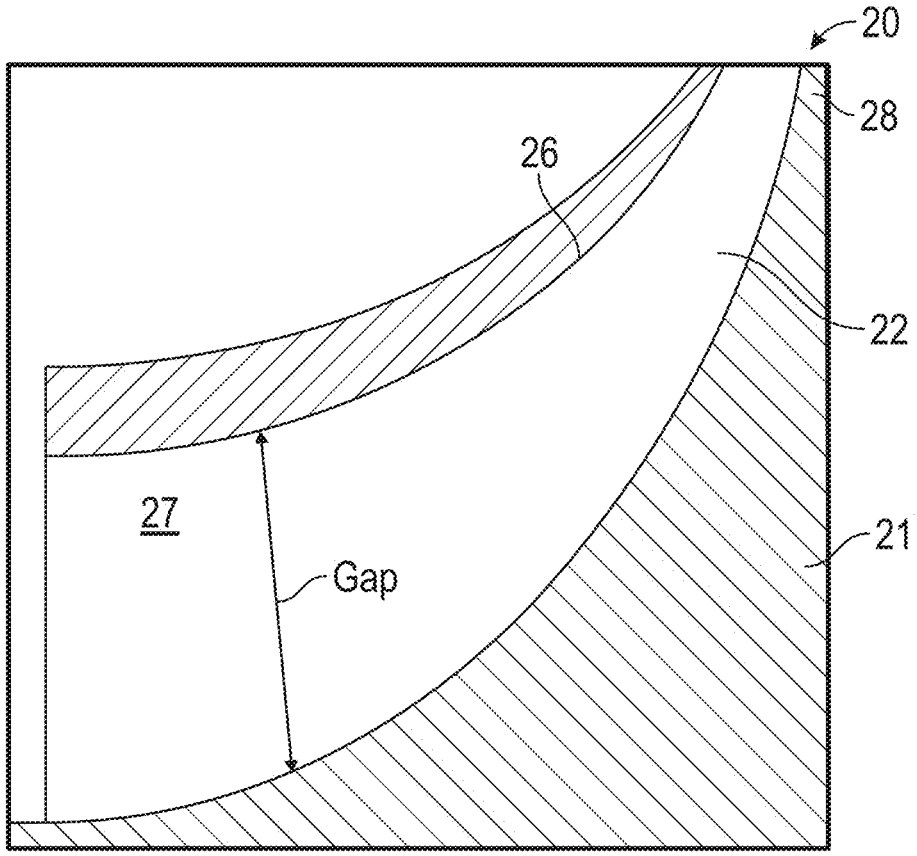
FIG. 2 (Prior Art)
FIG. 2 is a schematic cross-sectional view of a prior art impeller in accordance with embodiments.

FIGS. 1 and 2 illustrate a prior art turbofan gas turbine engine 10 of a type preferably provided for use in subsonic flight of an aircraft and a prior art impeller 20.

The gas turbine engine 10 generally includes in serial flow communication a fan 12 through which ambient air is propelled, a multistage high-pressure compressor (HPC) 14 for pressurizing the air having an axial compressor 13 and a centrifugal compressor 15, an impeller shroud 150, a diffuser 151, a combustor 16 and a turbine section 18. The impeller shroud 150 is adjacent to the centrifugal compressor 15 and forms a fluid flow path for air being compressed with the centrifugal compressor 15. The diffuser 151 is downstream from the centrifugal compressor 15 and directs compressed air from the centrifugal compressor 15 to the combustor 16. The compressed air is mixed with fuel and ignited is the combustor 16 for generating an annular stream of hot combustion gases. The turbine section 18 is configured to extract energy from the combustion gases. The center axis 11 of the engine 10 is also illustrated.

The centrifugal compressor 15 axially receives a compressible fluid, increases the pressure of the compressible fluid and conveys it in a substantially radial direction. The working or compressible fluid can be any fluid which can experience significant variations in density and in most instances is air or another gas. The centrifugal compressor 15 includes at least an impeller 20, which increases the pressure of the compressible fluid before conveying it downstream and the impeller shroud 150, which houses the impeller 20 and provides structure to the centrifugal compressor 15.

The impeller 20 can be any device which can rotate about a central axis so as to increase the pressure of the compressible fluid. The impeller 20 has an impeller hub 21 and multiple impeller vanes 22 extending from the impeller hub 21. The impeller 20 is mounted to a shaft 24 which rotates, along with the impeller 20, about a shaft axis that can be coaxial with center axis 11. The impeller shroud 150 houses or encloses the impeller 20 and includes a shroud body, which provides the impeller shroud 150 with structure and an ability to resist loads generated by the centrifugal compressor 15 when in operation. The impeller shroud 150 also has a shroud surface 26, which is exposed to the compressible fluid and which surrounds the impeller vanes 22. The shroud surface 26 and the impeller hub 21 respectively extend between an inducer portion 27 and an exducer portion 28.

Figure 3A:
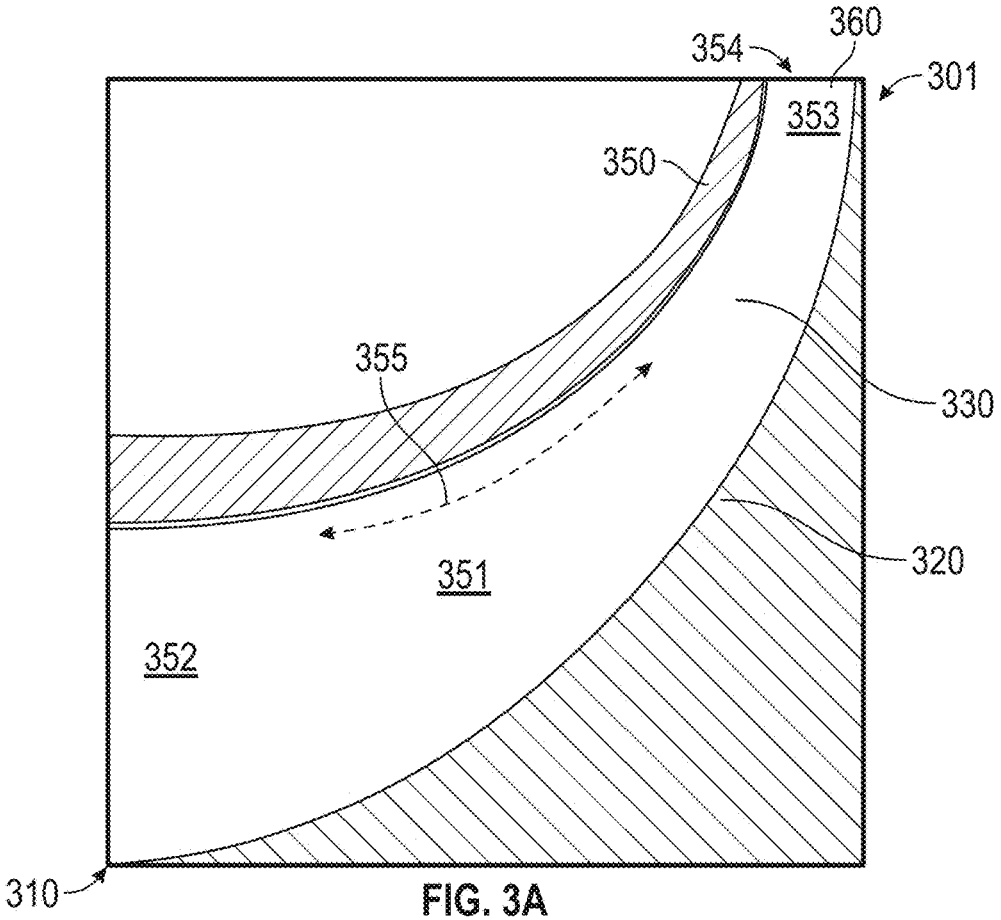
FIGS. 3A and 3B are side and perspective views of an impeller of a centrifugal compressor in accordance with embodiments.
Figure 3B:
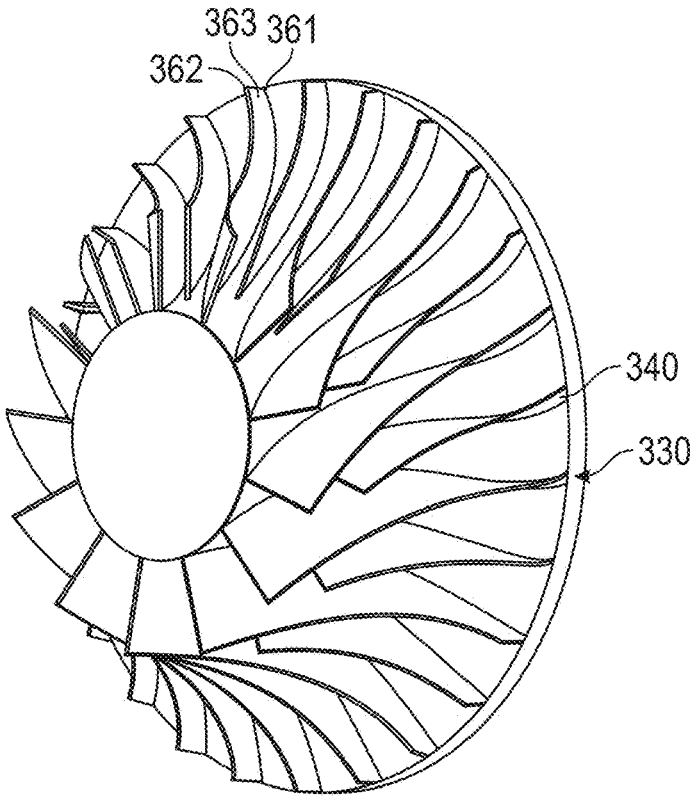

With continued reference to FIGS. 1 and 2 and with additional reference to FIGS. 3A and 3B, a centrifugal compressor 301 of an aircraft gas turbine engine, such as the centrifugal compressor 15 of the gas turbine engine 10 of FIG. 1, is provided. The centrifugal compressor 301 includes an impeller 310. The impeller 310 includes an impeller hub 320, impeller main vanes 330, impeller splitter vanes 340 and an impeller shroud 350. The impeller shroud 350 surrounds the impeller hub 320 and surrounds the impeller main vanes 330 and the impeller splitter vanes 340 to form a flow path 351 from an inducer portion 352 at an upstream side of the impeller 310 to an exducer portion 353 at an impeller exit 354. It is to be understood that the impeller splitter vanes 340 are not required, however, and that embodiments exist in which the impeller 310 includes only impeller main vanes 330. The following description will relate to the cases in which the impeller 310 includes both impeller main vanes 330 and impeller splitter vanes 340 for purposes of clarity and brevity.

The impeller main vanes 330 extend from the inducer portion 352 to the exducer portion 353. The impeller splitter vanes 340 are interleaved with the impeller main vanes 330 and extend to the exducer portion 353 from an impeller mid-point. In accordance with embodiments, the impeller mid-point can be defined as an impeller knee 355, which is interposed between the inducer portion 352 and the exducer portion 353 and which is characterized as being a range of locations where the flow path 351 changes from a predominantly axial direction to a predominantly radial direction.

Figure 4:
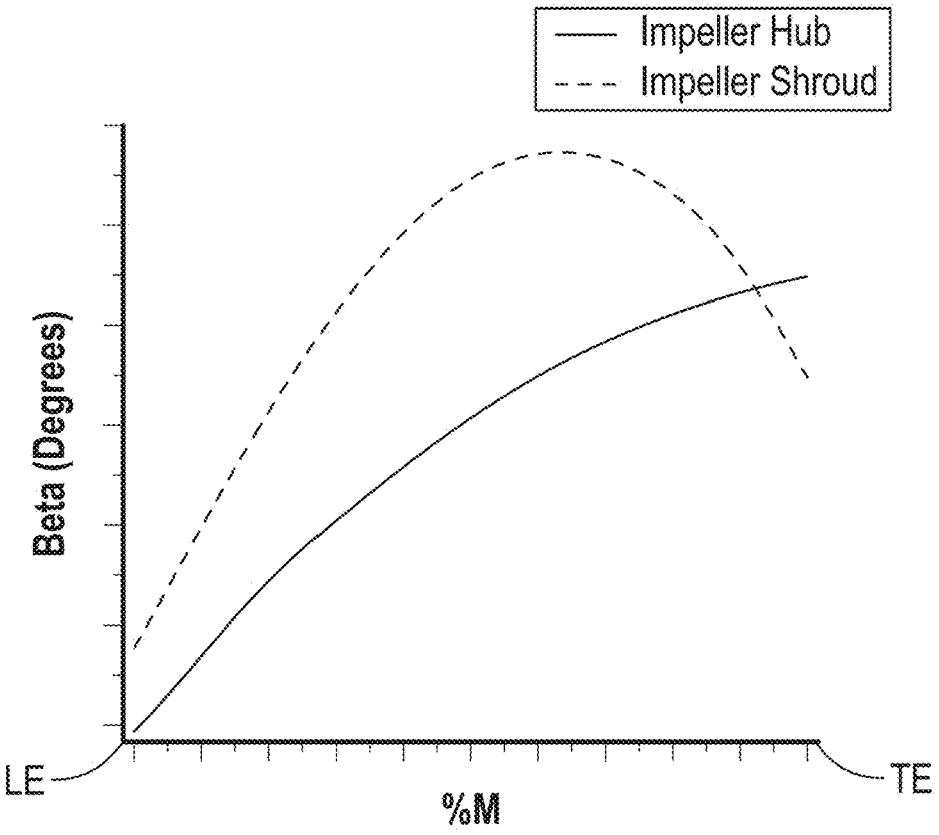
FIG. 4 is a graphical illustration of backsweep exhibited by a trailing edge of an impeller main vane at an impeller hub and at an impeller shroud in accordance with embodiments.
Figure 5:
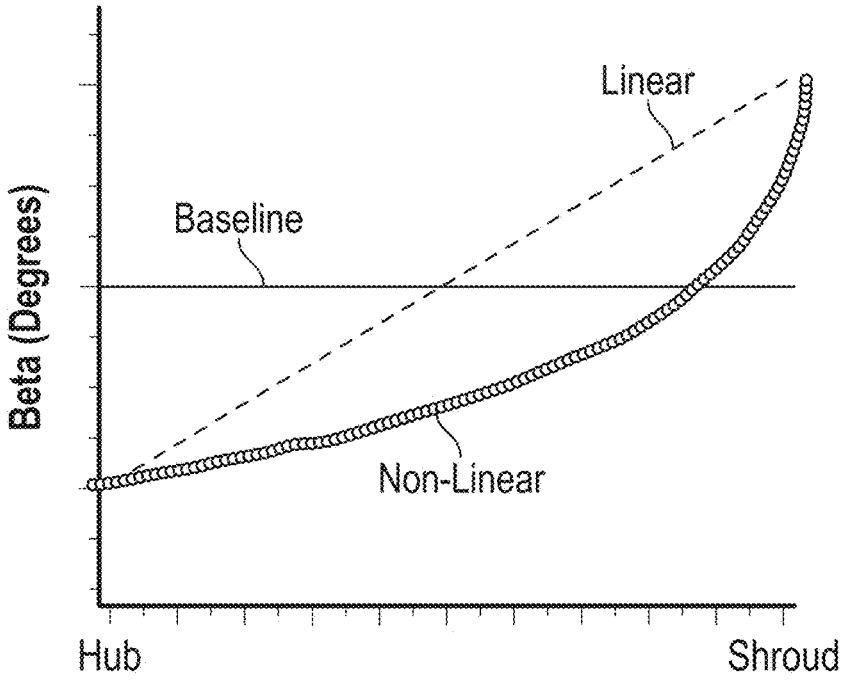
FIG. 5 is a graphical illustration of linear and non-linear distributions of backsweep change of a trailing edge of an impeller main vane in accordance with embodiments.

With continued reference to FIGS. 3A and 3B and with additional reference to FIGS. 4 and 5, each of the impeller main vanes 330 includes, at the impeller exit 354, a trailing edge 360. The trailing edge 360 of one or more of the impeller main vanes 330 includes a hub-side trailing edge portion 361, which is proximate or adjacent to the impeller hub 320 and which exhibits backsweep of a first degree, a shroud-side trailing edge portion 362, which is proximate to and displaced from the impeller shroud 350 and which exhibits backsweep of a second degree, and a central trailing edge portion 363 that is interposed between the hub-side trailing edge portion 361 and the shroud-side trailing edge portion 362. In at least one or more cases, the hub-side trailing edge portion 361 exhibits the backsweep of the first degree and the shroud-side trailing edge portion 362 exhibits the backsweep of the second degree for each of the impeller main vanes 330.

In accordance with embodiments and as shown in FIG. 4, the backsweep of the second degree exhibited by the shroud-side trailing edge portion 362 is less than the backsweep of the first degree exhibited by the hub-side trailing edge portion 361 (i.e., from about 90-95% chord to 100% chord) and, more particularly, the backsweep of the second degree exhibited by the shroud-side trailing edge portion 362 is less than the backsweep of the first degree exhibited by the hub-side trailing edge portion 362 by at least 10 degrees in absolute value. In an exemplary case, an angle of the backsweep of the second degree exhibited by the shroud-side trailing edge portion 362 can be about negative fifteen degrees) (−15° and an angle of the backsweep of the first degree exhibited by the hub-side trailing edge portion 361 can be about negative twenty-five) degrees (−25°. According to a non-limiting embodiment, zero degrees) (0° backsweep represents a radial blade exit (perpendicular to the engine axis). Negative angles are referred to as "backswept" and have the blades curving away from the direction of rotation, while positive angles are "forward" swept and have the blades angled IN the direction of rotation).

In accordance with further embodiments and as shown in FIG. 5, a change of the backsweep of the second degree exhibited by the shroud-side trailing edge portion 362 to the backsweep of the first degree exhibited by the hub-side trailing edge portion 361 can be one of distributed linearly over a length of the impeller and distributed non-linearly over a length of the impeller.

Figure 6A:
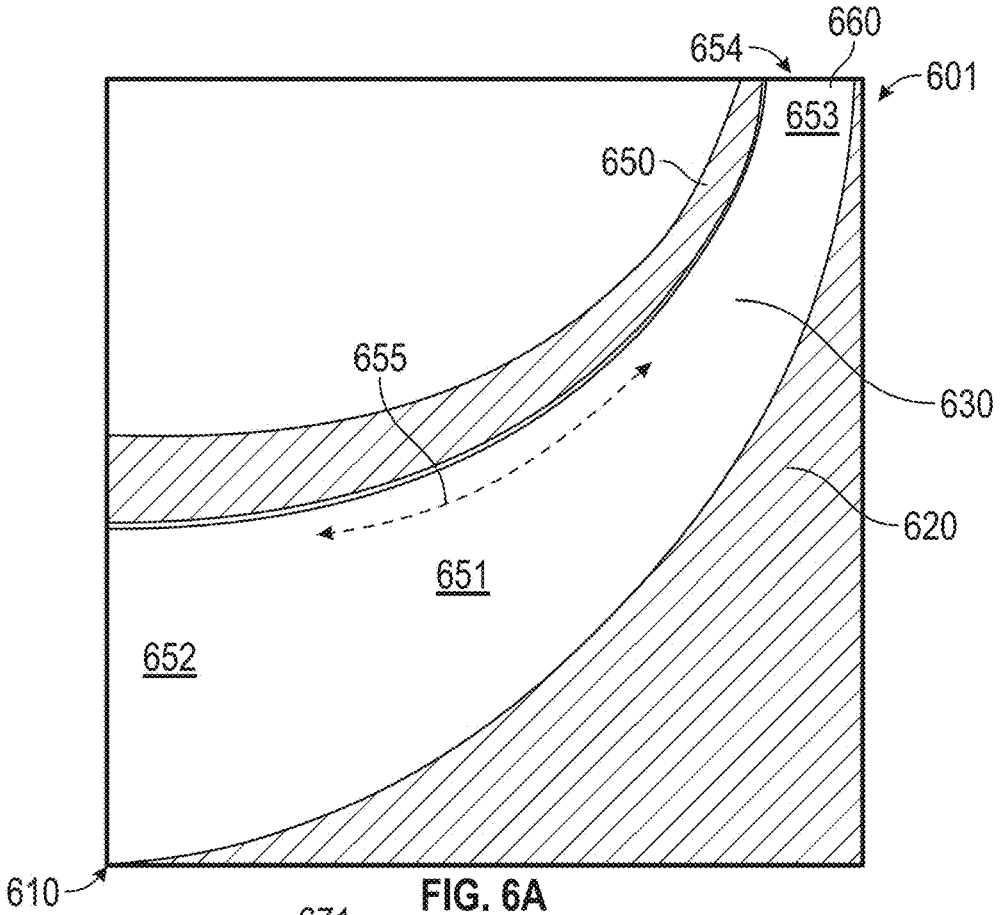
FIGS. 6A and 6B are side and perspective views of an impeller with main and splitter vanes of a centrifugal compressor in accordance with embodiments.
Figure 6B:
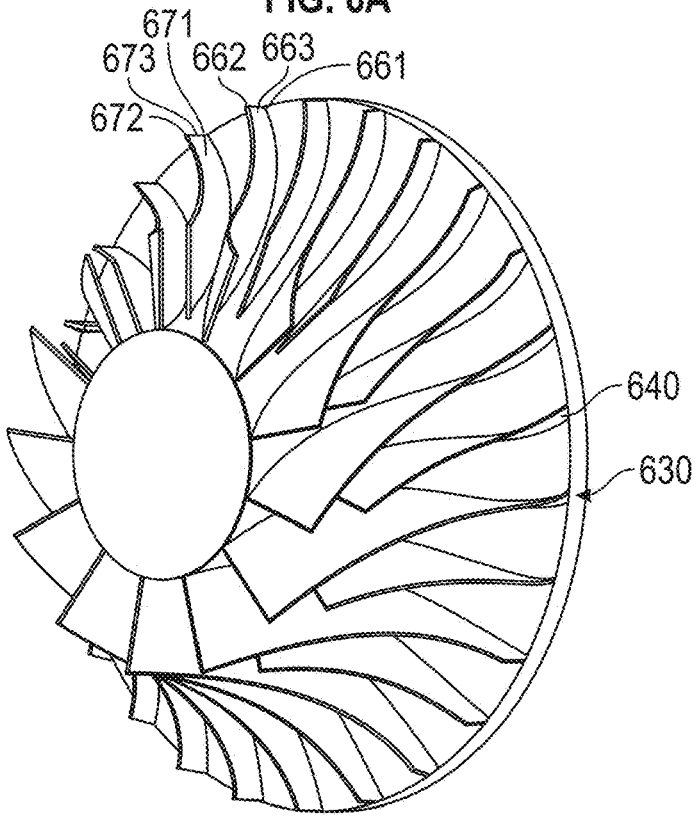

With reference back to FIGS. 1 and 2 and with additional reference to FIGS. 6A and 6B, a centrifugal compressor 601 of an aircraft gas turbine engine, such as the centrifugal compressor 15 of the gas turbine engine 10 of FIG. 1, is provided. The centrifugal compressor 601 includes an impeller 610. The impeller 610 includes an impeller hub 620, impeller main vanes 630, impeller splitter vanes 640 and an impeller shroud 650. The impeller shroud 650 surrounds the impeller hub 620 and surrounds the impeller main vanes 630 and the impeller splitter vanes 640 to form a flow path 651 from an inducer portion 652 at an upstream side of the impeller 610 to an exducer portion 653 at an impeller exit 654.

The impeller main vanes 630 extend from the inducer portion 652 to the exducer portion 653. The impeller splitter vanes 640 are interleaved with the impeller main vanes 630 and extend to the exducer portion 653 from an impeller mid-point. In accordance with embodiments, the impeller mid-point can be defined as an impeller knee 655, which is interposed between the inducer portion 652 and the exducer portion 653 and which is characterized as being a range of locations where the flow path 651 changes from a predominantly axial direction to a predominantly radial direction.

Figure 7:
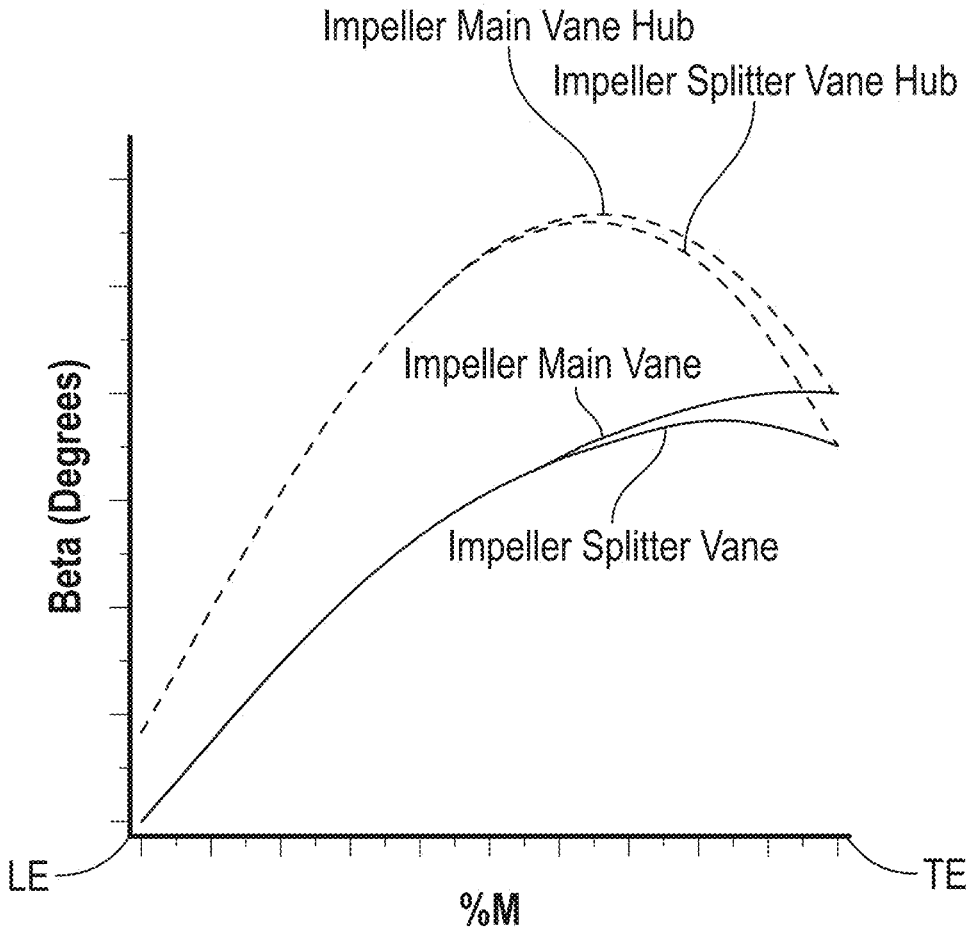
FIG. 7 is a graphical illustration of backsweep exhibited by trailing edges of impeller main and splitter vanes in accordance with embodiments.

With continued reference to FIGS. 6A and 6B and with additional reference to FIG. 7, each of the impeller main vanes 630 includes, at the impeller exit 654, a trailing edge 660 and each of the impeller splitter vanes 640 includes, at the impeller exit 654, a trailing edge 670. The trailing edge 660 of each of the impeller main vanes 630 includes a hub-side trailing edge portion 661, which is proximate or adjacent to the impeller hub 620, a shroud-side trailing edge portion 662, which is proximate to and displaced from the impeller shroud 650 and a central trailing edge portion 663 that is interposed between the hub-side trailing edge portion 661 and the shroud-side trailing edge portion 662. The trailing edge 670 of each of the impeller splitter vanes 640 includes a hub-side trailing edge portion 671, which is proximate or adjacent to the impeller hub 620, a shroud-side trailing edge portion 672, which is proximate to and displaced from the impeller shroud 650 and a central trailing edge portion 673 that is interposed between the hub-side trailing edge portion 671 and the shroud-side trailing edge portion 672.

For one or more pairs of the impeller main vanes 630 and the impeller splitter vanes 640, the trailing edge 670 of the splitter vane 640 exhibits backsweep of a first degree and a same backsweep at the hub-side trailing edge portion 671 and at the shroud-side trailing edge portion 672 and the trailing edge 660 of the impeller main vane 630 exhibits backsweep of a second degree and a same backsweep at the hub-side trailing edge portion 661 and at the shroud-side trailing edge portion 662.

In accordance with embodiments and as shown in FIG. 7, for the one or more pairs of the impeller main vanes 630 and the impeller splitter vanes 640, the backsweep of the first degree exhibited by the trailing edge 670 of the impeller splitter vane 640 can be variable but in any case differs from the backsweep of the second degree exhibited by the trailing edge 660 of the impeller main vane 630 by about 5 degrees in absolute value and, more particularly, for the one or more pairs of the impeller main vanes 630 and the impeller splitter vanes 640, the backsweep of the first degree exhibited by the trailing edge 670 of the impeller splitter vane 640 can be variable but in any case exceeds the backsweep of the second degree exhibited by the trailing edge 660 of the impeller main vane 630 (i.e., from about 50%-70% chord to 100% chord). In an exemplary case, for the one or more pairs of the impeller main vanes 630 and the impeller splitter vanes 640, an angle of the backsweep of the first degree exhibited by the trailing edge 670 of the impeller splitter vane 640 is about −25 degrees and an angle of the backsweep of the second degree exhibited by the trailing edge 660 of the impeller main vane 630 is about −20 degrees. In at least one or more cases, the backsweep of the first degree exhibited by the trailing edge 670 of each of the impeller splitter vanes 640 differs from the backsweep of the second degree exhibited by the trailing edge 660 of each of the impeller main vane 630 by about 5 degrees in absolute value and, more particularly, the backsweep of the first degree exhibited by the trailing edge 670 of each of the impeller splitter vanes 640 exceeds the backsweep of the second degree exhibited by the trailing edge 660 of each of the impeller main vane 630 (i.e., from about 50%-70% chord to 100% chord).

Technical effects and benefits of the features described herein are the provision of an impeller of a centrifugal compressor with a modified impeller exit blade angle or by altering splitter blade backsweep relative to main blade backsweep. In either or both cases, the modification(s) leads to improved exit flow conditions achieved by a flattened pressure profile that in turn result in improved diffuser performance.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A centrifugal compressor of an aircraft gas turbine engine, the centrifugal compressor comprising:

an impeller comprising a hub, vanes and a shroud surrounding the hub and the vanes to form a flow path from an inducer portion at an upstream side of the impeller to an exducer portion at an impeller exit, each vane comprising, at the impeller exit, a trailing edge and the trailing edge of one or more vanes comprising:

a hub-side trailing edge portion proximate to the hub and exhibiting backsweep of a first degree; and a shroud-side trailing edge portion proximate to the shroud and exhibiting backsweep of a second degree, wherein a magnitude of the backsweep of the second degree is less than a magnitude of the backsweep of the first degree, and wherein a change of the backsweep of the second degree exhibited by the shroud-side trailing edge portion to the backsweep of the first degree exhibited by the hub-side trailing edge portion is distributed linearly.

2. A centrifugal compressor of an aircraft gas turbine engine, the centrifugal compressor comprising:

an impeller comprising a hub, main and splitter vanes and a shroud surrounding the hub and the main and splitter vanes to form a flow path from an inducer portion at an upstream side of the impeller to an exducer portion at an impeller exit, the main vanes extending from the inducer portion to the exducer portion, the splitter vanes being interleaved with the main vanes and extending to the exducer portion from an impeller mid-point, and each main vane comprising, at the impeller exit, a trailing edge and the trailing edge of one or more main vanes comprising:

a hub-side trailing edge portion proximate to the hub and exhibiting backsweep of a first degree; and a shroud-side trailing edge portion proximate to the shroud and exhibiting backsweep of a second degree, wherein a magnitude of the backsweep of the second degree is less than a magnitude of the backsweep of the first degree, wherein a change of the backsweep of the second degree exhibited by the shroud-side trailing edge portion to the backsweep of the first degree exhibited by the hub-side trailing edge portion is distributed linearly.

* * * * *